US010541077B2

(12) United States Patent
Fogelberg

(10) Patent No.: US 10,541,077 B2
(45) Date of Patent: Jan. 21, 2020

(54) HYBRID TRANSFORMER CORES

(71) Applicant: ABB Schweiz AG, Baden (CH)

(72) Inventor: Thomas Fogelberg, Ludvika (SE)

(73) Assignee: ABB Schweiz AG, Baden (CH)

( * ) Notice: Subject to any disclaimer, the term of this patent is extended or adjusted under 35 U.S.C. 154(b) by 403 days.

(21) Appl. No.: 14/414,662

(22) PCT Filed: May 30, 2013

(86) PCT No.: PCT/EP2013/061172
§ 371 (c)(1),
(2) Date: Jan. 13, 2015

(87) PCT Pub. No.: WO2014/009054
PCT Pub. Date: Jan. 16, 2014

(65) Prior Publication Data

US 2015/0213943 A1 Jul. 30, 2015

(30) Foreign Application Priority Data

Jul. 13, 2012 (EP) ..... 12176379

(51) Int. Cl.
*H01F 17/04* (2006.01)
*H01F 27/26* (2006.01)
*H01F 41/02* (2006.01)

(52) U.S. Cl.
CPC ..... *H01F 27/263* (2013.01); *H01F 41/02* (2013.01); *Y10T 29/49004* (2015.01)

(58) Field of Classification Search
CPC .... H01F 30/16; H01F 17/045; H01F 27/2847; H01F 3/10; H01F 30/10; H01F 27/263;
(Continued)

(56) References Cited

U.S. PATENT DOCUMENTS 3,183,461 A * 5/1965 Tipton ..... H01F 27/245 336/212
3,504,318 A * 3/1970 Hattrup ..... H01F 27/245 336/12

(Continued)

FOREIGN PATENT DOCUMENTS

CN 1065155 A 10/1992
DE 3918187 A1 12/1989

OTHER PUBLICATIONS

European Search Report Application No. EP 12 17 6379 Completed: Nov. 23, 2012; dated Dec. 7, 2012 6 pages.

(Continued)

*Primary Examiner* — Elvin G Enad
*Assistant Examiner* — Kazi S Hossain
(74) *Attorney, Agent, or Firm* — Whitmyer IP Group LLC

(57) ABSTRACT

A hybrid transformer core includes a first yoke of amorphous steel and a second yoke of amorphous steel. The hybrid transformer core further includes at least two limbs of grain-oriented steel extending between the first yoke and the second yoke. The first end of each one of the at least two limbs is coupled to a first surface of the first yoke in a first connection plane and wherein a second end of each one of the at least two limbs is coupled to a second surface of the second yoke in a second connection plane. The first surface in all directions along the first connection plane extends beyond the first end of each one of the at least two limbs. The second surface in all directions along the second connection plane extends beyond the second end of each one of the at least two limbs.

20 Claims, 4 Drawing Sheets

(58) Field of Classification Search
CPC ..... H01F 41/02; H01F 27/24; H01F 41/0233; Y10T 29/49004
USPC ..... 336/221, 212, 233
See application file for complete search history.

(56) References Cited

U.S. PATENT DOCUMENTS 4,201,966 A * 5/1980 De Laurentis ..... H01F 27/245 336/217
4,471,271 A * 9/1984 Wendt ..... G05F 3/06 315/411
4,668,931 A * 5/1987 Boenitz ..... H01F 27/245 336/212
4,769,900 A * 9/1988 Morinaga ..... H01F 27/292 29/606
4,924,201 A * 5/1990 Ballard ..... H01F 41/024 336/210
5,414,401 A * 5/1995 Roshen ..... H01F 30/10 336/178
7,612,640 B2 * 11/2009 Sano ..... H01F 27/255 336/83
2004/0085173 A1 * 5/2004 Decristofaro ..... H01F 27/245 336/178
2005/0237146 A1 * 10/2005 Hirzel ..... H01F 27/25 336/212
2008/0068119 A1 * 3/2008 Avila Montes ..... H01F 29/14 336/155
2010/0308951 A1 * 12/2010 Salomaki ..... H01F 3/08 336/233
2011/0001595 A1 * 1/2011 Kudo ..... H01F 17/045 336/192
2011/0025445 A1 * 2/2011 Lai ..... H01F 3/10 336/220
2011/0115590 A1 * 5/2011 Park ..... H01F 27/385 336/12
2011/0227687 A1 * 9/2011 Eriksson ..... H01F 37/00 336/178
2011/0279212 A1 * 11/2011 Ikriannikov ..... H01F 17/0006 336/192
2012/0068805 A1 * 3/2012 Levin ..... H01F 27/245 336/212
2012/0075047 A1 * 3/2012 Luckey ..... H01F 27/25 336/60
2012/0139684 A1 * 6/2012 Kobayashi ..... H01F 27/022 336/92

OTHER PUBLICATIONS

International Search Report & Written Opinion of the International Searching Authority Application No. PCT/EP2013/061172 Completed: Aug. 12, 2013; dated Aug. 23, 2013 10 pages.
Chinese Office Action Application No. 201380037207 dated Feb. 29, 2016 5 pages.
Chinese Search Report Application No. 201380037207 dated Feb. 19, 2016 2 pages.

* cited by examiner

HYBRID TRANSFORMER CORES

TECHNICAL FIELD

The present disclosure relates to hybrid transformer cores, especially such hybrid transformer cores which combine yokes of amorphous steel with limbs of grain-oriented steel.

BACKGROUND

Over the past decades, communities all over the world have made concerted efforts to reduce the risk of global warming. Unfortunately, there is no single unique solution to the problem. Thus, during the coming decades energy efficiency will be a critical factor in reducing carbon emissions and fighting global warming. The power generation industry and transmission and distribution industries (T&D) contribute to a large part of energy losses in the society. The losses in T&D systems alone are total 10% of a global average of the T&D energy transferred.

There is thus a need for investments in efficient use of energy, in the energy efficiency of electric power infrastructures and in renewable resources. Development of an efficient system for using electricity may enable larger scale use of primary energy in the form of electricity compared to the situation today.

Contributing to at least one-third of total T&D losses, transformers and shunt reactors are commonly the most expensive components in the power system and hence efficient design of these power devices could reduce the T&D losses.

Moreover, the European Commission (EC) has set a series of goals demanding climate and energy targets to be met by 2020, known as the "20-20-20" targets. In line with the "20/20/20" targets the European Commission (EC) and organizations making transformer standards are currently working on developing directives to reduce transformer losses.

One way to reduce losses in transformers are not only to buy transformers with minimum losses as defined in standards e.g. EN 50464-1 but also to apply loss evaluation values in the procurement process.

Available scientific methods to reduce transformer losses below the present level, are scanty. However, one method for distribution transformers is to use amorphous steel in as the core material. With this amorphous technology may be possible to reduce the no load losses up to 70%. Also by decreasing the current density and/or flux density below the limit needed for a reliable transformer, a wide range of transformer designs with lower losses can be achieved with more material.

U.S. Pat. No. 4,668,931 discloses a transformer core having one or more winding legs built up from a plurality of silicon steel laminations and a pair of yokes built up from a plurality of amorphous steel laminations. The yokes and legs are serially joined by silicon steel-amorphous steel lamination joints to create a magnetic loop circuit and thus provide a transformer core having significantly improved core loss characteristics as compared to a power transformer core formed exclusively of silicon steel laminations.

However, there is still a need for an improved transformer design.

SUMMARY

In view of the above, a general object of the present disclosure is to provide an improved transformer design resulting in low losses. A number of different factors have been identified which may reduce different kind of losses.

A particular object of the present disclosure is to provide an improved hybrid transformer cores which combine yokes of amorphous steel with limbs of grain-oriented steel.

Hence, according to a first aspect of the present disclosure there is provided a hybrid transformer core. The hybrid transformer core comprises a first yoke of amorphous steel and a second yoke of amorphous steel. The hybrid transformer core further comprises at least two limbs of grain-oriented steel extending between the first yoke and the second yoke. The first end of each one of the at least two limbs is coupled to a first surface of the first yoke in a first connection plane and wherein a second end of each one of the at least two limbs is coupled to a second surface of the second yoke in a second connection plane. The first surface in all directions along the first connection plane extends beyond the first end of each one of the at least two limbs. The second surface in all directions along the second connection plane extends beyond the second end of each one of the at least two limbs.

Advantageously the hybrid transformer core provides improvements for domain refined steel allowing thinner steel sheets than currently in use. The combination of amorphous isotropic core materials with highly anisotropic and domain refined steel in transformers are energy efficient.

Advantageously the disclosed hybrid transformer core provides advanced control of core flux by the provided core joints. Anisotropy of the core material as well as core dimensions has great potential to reduce core losses.

Advantageously the disclosed hybrid transformer core provides leakage flux control methods to reduce losses in windings, tanks and other structural, magnetic support materials.

According to embodiments the yokes have a height of about 1.3 times the diameter of the limbs. Thus: each one of the at least two limbs has a diameter, wherein the first yoke may extend perpendicularly from the first connection plane 1.1-1.5 times, preferably 1.2-1.4 times, most preferably 1.3 times said diameter, and wherein the second yoke extends perpendicularly from the second connection plane 1.1-1.5 times, preferably 1.2-1.4 times, most preferably 1.3 times said diameter.

According to a second aspect there is provided a reactor comprising at least one hybrid transformer core according to the first aspect.

According to a third aspect there is provided a method of manufacturing a hybrid transformer core, preferably the hybrid transformer core according to the first aspect. The method comprises building yokes as beams from bands of amorphous steel; assembling a hybrid transformer core by using the built beams; and installing, testing, and/or operating the assembled hybrid transformer core.

Building yokes as beams from bands of amorphous steel may comprise cutting the bands to plates of amorphous steel; stacking the cut plates; gluing the plates during stacking; and/or assembling two or more individual beams, thereby forming a composite beam. These manufacturing steps may also be used to build grain-oriented limbs as beams to plates with thinner anisotropic core steel than are commercially available today to further reduce losses in the hybrid core. The yokes can also be built as coils, rings, ellipsoids, etc.

Assembling a hybrid transformer core may comprise placing the second yoke according to a preferred configuration; attaching the limbs to the second yoke, thereby coupling the limbs to the second yoke; placing windings over at least one of the limbs; attaching the first yoke to the limbs, thereby coupling the first yoke to the limbs; mounting connection means to the windings; and/or placing the hybrid transformer core in a box and fastening at least one of the first yoke and the second yoke to the box by fastening means.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
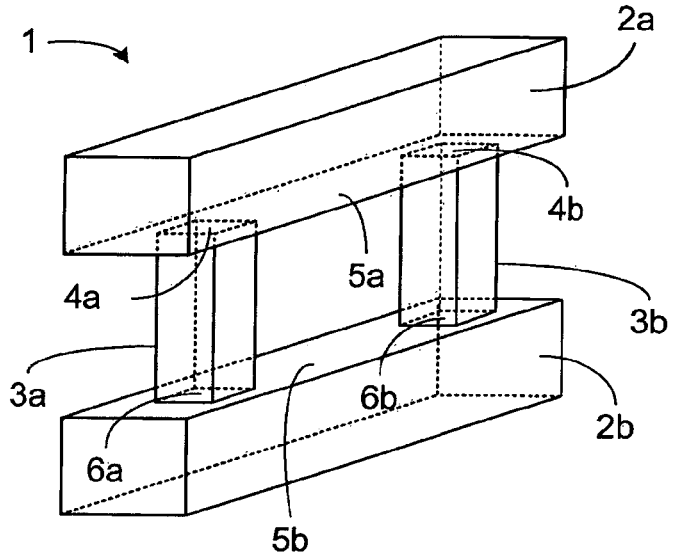
FIGS. 1-10 illustrate transformer cores according to embodiments.

FIG. 1 is a perspective view of a hybrid transformer core 1 according to a preferred embodiment. The vertical portions (around which windings are wound) of the transformer core are commonly referred to as limbs or legs 3*a*, 3*b* and the top and bottom portions of the transformer core are commonly referred to as yokes 2*a*, 2*b*. As in FIG. 1, single phase core-type transformers may have two limbed cores. However, also other configurations are possible.

In general terms, transformers are commonly used to transfer electrical energy from one circuit to another through inductively coupled conductors. The inductively coupled conductors are defined by the transformer's coils. A varying current in the first or primary winding creates a varying magnetic flux in the transformer's core and thus a varying magnetic field through the secondary winding.

Some transformers, such as transformers for use at power or audio frequencies, typically have cores made of high permeability silicon steel. The steel has a permeability many times that of free space and the core thus serves to greatly reduce the magnetizing current and confine the flux to a path which closely couples the windings One common design of a laminated core is made from interleaved stacks of E-shaped steel sheets capped with I-shaped pieces. Transformers with such cores are commonly referred to as E-I transformers. E-I transformers tend to exhibit more losses than traditional transformers. On the other hand, E-I transformers are economical to manufacture.

In common hybrid transformer cores the yokes are made from amorphous steel whereas the limbs are made from grain-oriented core steel. Commonly the magnetic core is composed of a stack of thin silicon-steel lamination. For 50 Hz transformers the laminates are typically in the order of about 0.23-0.35 mm thick. In this disclosure it would be possible to further make the grain-oriented steel thinner. In order to reduce eddy current losses, the laminations must be insulated from one another, for example by thin layers of varnish. In order to reduce the core losses, transformers may have their magnetic core made from cold-rolled grain-oriented sheet steel. This material, when magnetized in the rolling direction, has low core loss and high permeability.

The disclosed embodiments relate to hybrid transformer cores, especially such hybrid transformer cores which combine yokes of amorphous steel and limbs of grain-oriented steel.

The hybrid transformer core of FIG. 1 will now be described in more detail. The hybrid transformer 1 core comprises a first yoke 2*a* and a second yoke 2*b*. The first yoke 2*a* and the second yoke 2*b* are composed of amorphous steel. Preferably there is the same isotropy in all directions of the yokes 2*a*, 2*b*. Thus, amorphous steel of the first yoke 2*a* and the second yoke 2*b* preferably have the same isotropy in all directions.

The first yoke 2*a* may be regarded as a top yoke and the second yoke 2*b* may be regarded as a bottom yoke. The first yoke 2*a* and the second yoke 2*b* may typically be regarded as beams. The beams may take one of a number of different shapes. The shape may generally be defined by the cross-section of the beams. According to a preferred embodiment each one of the first yoke 2*a* and the second yoke 2*b* has a rectangular shaped cross-section. According to another embodiment the cross-section is squared. According to yet another embodiment the cross-section is ellipsoidal. According to yet another embodiment the cross-section is circular.

The hybrid transformer core further comprises a number of limbs 3*a*, 3*b*. The limbs 3*a*, 3*b* are composed of grain-oriented steel. According to a preferred embodiment each one of the first limb 3*a* and the second limb 3*b* has a rectangular shaped cross-section. According to another embodiment the cross-section is squared. According to yet another embodiment the cross-section is ellipsoidal. According to yet another embodiment the cross-section is circular.

Preferably the hybrid transformer core comprises at least two limbs 3*a*, 3*b*, as in FIG. 1. The limbs 3*a*, 3*b* are positioned between the first (top) yoke 2*a*, and the second (bottom) yoke 2*b*. Put in other words, the limbs 3*a*, 3*b* extend between the first yoke 2*a* and the second yoke 2*b*.

Figure 2:
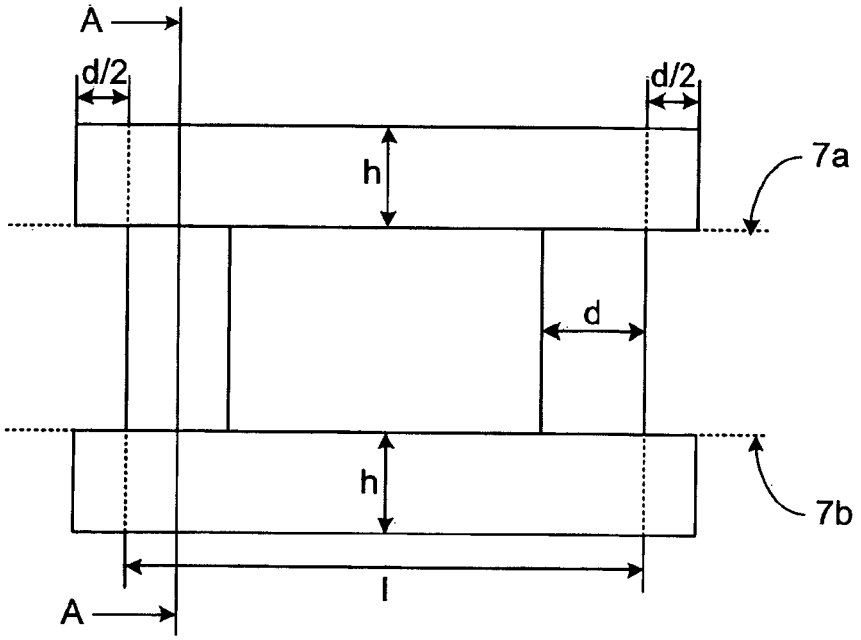
Figure 3:
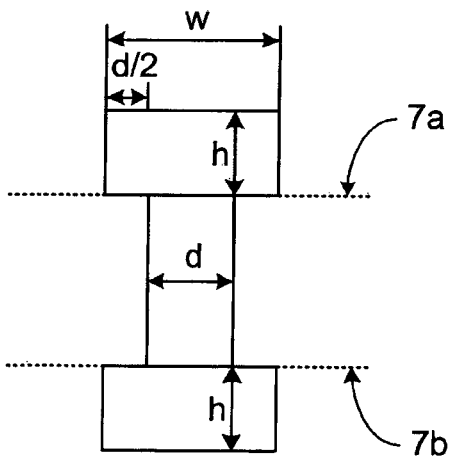

Further, the limbs 3*a*, 3*b* are coupled to the yokes 2*a*, 2*b*. Particularly, a first end 4*a*, 4*b* of each one of the limbs is coupled to a first surface 5*a* of the first yoke 2*a*. A second end 6*a*, 6*b* of each one of the limbs is coupled to a second surface 5*b* of the second yoke 2*b*. The first surface 5*a* defines a first connection plane 7*a* and the second surface 5*b* defines a second connection plane 7*b*, see FIGS. 2 and 3. FIGS. 2 and 3 illustrate side views of the hybrid transformer core 1 of FIG. 1. FIG. 3 is a side view taken at cut A-A in FIG. 2. Preferably the first end 4*a*, 4*b* of each one of the limbs 3*a*, 3*b* is glued to the first surface 5*a* of the first yoke 2*a*. Likewise, preferably the second end 6*a*, 6*b* of each one of the limbs 3*a*, 3*b* is glued to the second surface 5*b* of the second yoke 2*b*. The yokes 2*a*, 2*b* may thus be directly glued to the limbs 3*a*, 3*b*. Preferably the yokes 2*a*, 2*b* are glued to the flat ends of the limbs 3*a*, 3*b*. Hence there is no longer any reason to have a 45 degrees connection, a step-lap connection or a non-step-lap connection between the yokes 2*a*, 2*b* and the limbs 3*a*, 3*b*. As amorphous steel is non-oriented the flux from the limbs 3*a*, 3*b* will be distributed by the lowest magnetic energy in the yokes 2*a*, 2*b*.

The yokes 2*a*, 2*b* are arranged such that the first surface 5*a* of the first yoke 2*a* faces the second surface 5*b* of the second yoke 2*b*. Thus the first connection plane 7*a* and the second connection plane 7*b* are preferably parallel. At the connection points (i.e. where the yokes 2*a*, 2*b* meet the limbs 3*a*, 3*b*) the yokes 2*a*, 2*b* are wider than the limbs 3*a*, 3*b*. That is, at the couplings between the yokes 2*a*, 2*b* and the limbs 3*a*, 3*b* the yokes 2*a*, 2*b* extend beyond the limbs 3*a*, 3*b* in all direction, see FIGS. 2 and 3. More particularly, the first surface 5*a* (of the first yoke 2*a*) in all directions along the first connection plane 7*a* extends beyond the first end 4*a*, 4*b* of each one of the at least two limbs 3*a*, 3*b*. Likewise, the second surface 5*b* (of the second yoke 2*b*) in all directions along the second connection plane 7*b* extends beyond the second end 6*a*, 6*b* of each one of the at least two limbs 3*a*, 3*b*. The yokes 2*a*, 2*b* thereby take both the core flux and the axial flux in relation to the air magnetic energy coupled to the transformer's 1 impedance. Thereby the yokes 2*a*, 2*b* are able to better distribute the flux from the limbs 3*a*, 3*b*, thereby reducing leakage. Thereby the disclosed transformers 1 also have less eddy losses in windings and other steel components.

Figure 7:
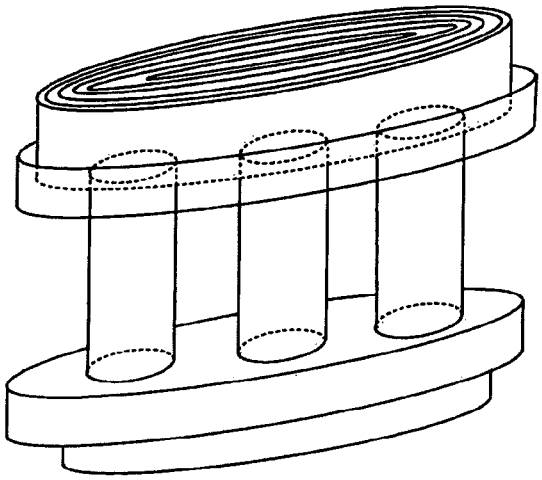
Figure 8:
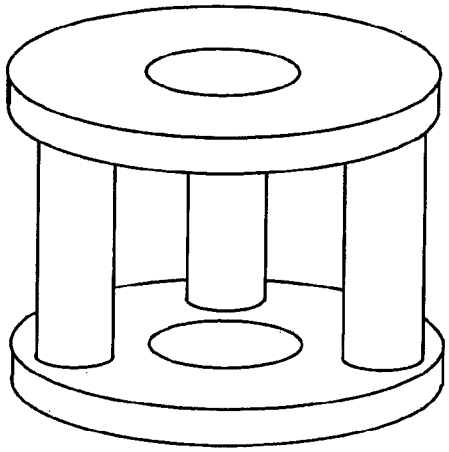

The number of limbs may vary. Typically there are two limbs (e.g. as in FIG. 1) or three limbs (e.g. as in FIGS. 7 and 8). In FIG. 7 there are three limbs 3*a*, 3*b*, 3*c* in a transformer core 1 having a line configuration. Further, as illustrated in FIG. 7, one of the yoke beams may be longer than the other yoke beam. The yoke beams to which the limbs are coupled are the longest yoke beams. In FIG. 8 there are three limbs 3*a*, 3*b*, 3*c* in a transformer core 1 having a circular configuration.

Preferably the yokes 2*a*, 2*b* have a height h which is larger than the maximum diameter d of the limbs 3*a*, 3*b*. Most preferably the height h is about 1.3 times higher than the maximum diameter d of the limbs 3*a*, 3*b*. According to one embodiment all limbs 3*a*, 3*b* may have the same diameter d. According to another embodiment the limbs 3*a*, 3*b* may have different diameters. In relation to the above defined first connection plane 7*a*, the first yoke 2*a* may extend perpendicularly from the first connection plane 7*a* 1.1-1.5 times, preferably 1.2-1.4 times, most preferably 1.3 times the diameter d of the limbs 3*a*, 3*b*. Likewise, in relation to the above defined second connection plane 7*b*, the second yoke 2*b* extends perpendicularly from the second connection plane 7*b* 1.1-1.5 times, preferably 1.2-1.4 times, most preferably 1.3 times the diameter d of the limbs 3*a*, 3*b*.

The yokes 2*a*, 2*b* are thus advantageously made higher than the maximum diameter d of the limbs 3*a*, 3*b* and also longer than the diameter d of the limbs 3*a*, 3*b* in order to compensate amorphous steel plates lower saturation. This implies that when the magnetic flux from a limb 3*a*, 3*b* enters an amorphous yoke 2*a*, 2*b* the flux must first overcome a small gap of air in the butt joint there between. When the flux reaches the amorphous yoke 2*a*, 2*b* the first "volume part" of the flux against the limb 3*a*, 3*b* is saturated, but the isotropy of the yoke 2*a*, 2*b* directly re-distributes the flux over a larger volume in the yoke 2*a*, 2*b*. This process may on the one hand minimally increase the losses but on the other hand gives rises to peaks in the magnetizing current and to a slightly higher idle reactance. The butt joint thus gives rise to two effects. Firstly, peaks in the magnetizing current. Secondly, 100 Hz or 120 Hz mechanical force compression between yokes and limbs. These effects may be minimized by use of wounded leakage flow rings at the end of the limbs, the rings acting to shunt the flow to the yokes 2*a*, 2*b*. Since the yokes 2*a*, 2*b* may be both longer and wider than the limbs 3*a*, 3*b*, the yokes 2*a*, 2*b* may also absorb the leakage flows of the phases.

Figure 4:
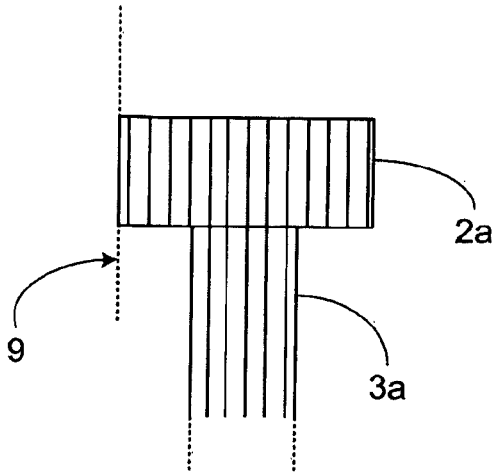
Figure 5:
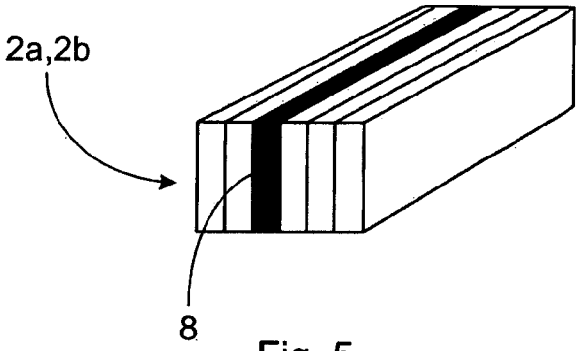

Preferably the first yoke 2*a* and the second yoke 2*b* are composed of a stacked plurality of yoke plates 8 of amorphous steel, as illustrated in FIGS. 4 and 5. The stacked plurality of yoke plates 8 may be glued together. The yokes 2*a*, 2*b* may therefore be regarded as glued packages where the mechanical strength is obtained by the glue. The yokes 2*a*, 2*b* are thereby a structural part formed together with the box in which the transformer 1 is placed. The yokes 2*a*, 2*b* thereby receive all forces. Define now a first plate plane 9 extending between the limbs 3*a*, 3*b* and being perpendicular to the first 7*a* and second 7*b* connection planes, see FIG. 4 which illustrates part of FIG. 3. The stacked plurality of yoke plates 8 is preferably oriented parallel to the first plate plane 9. The yoke plates 8 (also called laminates) are preferably glued together.

Figure 6:
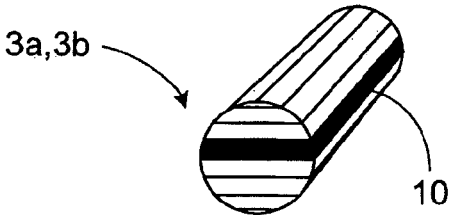

Preferably the limbs 3*a*, 3*b* are composed of a stacked plurality of limb plates 10 of grain-oriented steel. FIG. 6 illustrates a limb 3*a*, 3*b* having a plurality of limb plates 10. The plurality of limb plates 10 are preferably glued or bonded. The limbs 3*a*, 3*b* are oriented such that the stacked plurality of limb plates 10 preferably are parallel to the first plate plane 9. Moreover, the direction of flux in the oriented plates 10 of the limbs 3*a*, 3*b* is in the corners used so that the flux enters the yokes' 2*a*, 2*b* amorphous plates directly at a 90 degrees join.

As noted above the yokes 2*a*, 2*b* extend beyond the limbs 3*a*, 3*b* in all directions along the connection planes 7*a*, 7*b* between the yokes 2*a*, 2*b* and the limbs 3*a*, 3*b*. Thus the yokes 2*a*, 2*b* extend further beyond the limbs 3*a*, 3*b* than traditional yokes. For example, each yoke 2*a*, 2*b* is longer than the length 1 of the core. The first yoke 2*a* and the second yoke 2*b* may extend in length from the hybrid transformer core a total distance of at least the diameter d of one limb 3*a*, 3*b*. Thus, each yoke 2*a*, 2*b* may extend a total distance of at least half the diameter d of one limb 3*a*, 3*b* at end of the core. For example, each yoke 2*a*, 2*b* is wider than the limbs 3*a*, 3*b*. The first yoke 2*a* and the second yoke 2*b* may extend in width from the hybrid transformer core a total distance of at least the diameter d of one limb 3*a*, 3*b*. Thus, each yoke 2*a*, 2*b* may preferably extend a total distance of at least half the diameter of one limb 3*a*, 3*b* at each side of the limbs 3*a*, 3*b*. The width w of the yokes 2*a*, 2*b* may additionally and/or alternatively also be related to the windings of the limbs 3*a*, 3*b*. Thus at least one of the limbs 3*a*, 3*b* may have a winding 11*a*, 11*b*, thus forming a wound limb. The first yoke 2*a* and the second yoke 2*b* may have a width w of at least the diameter of the wound limb.

Figure 11:
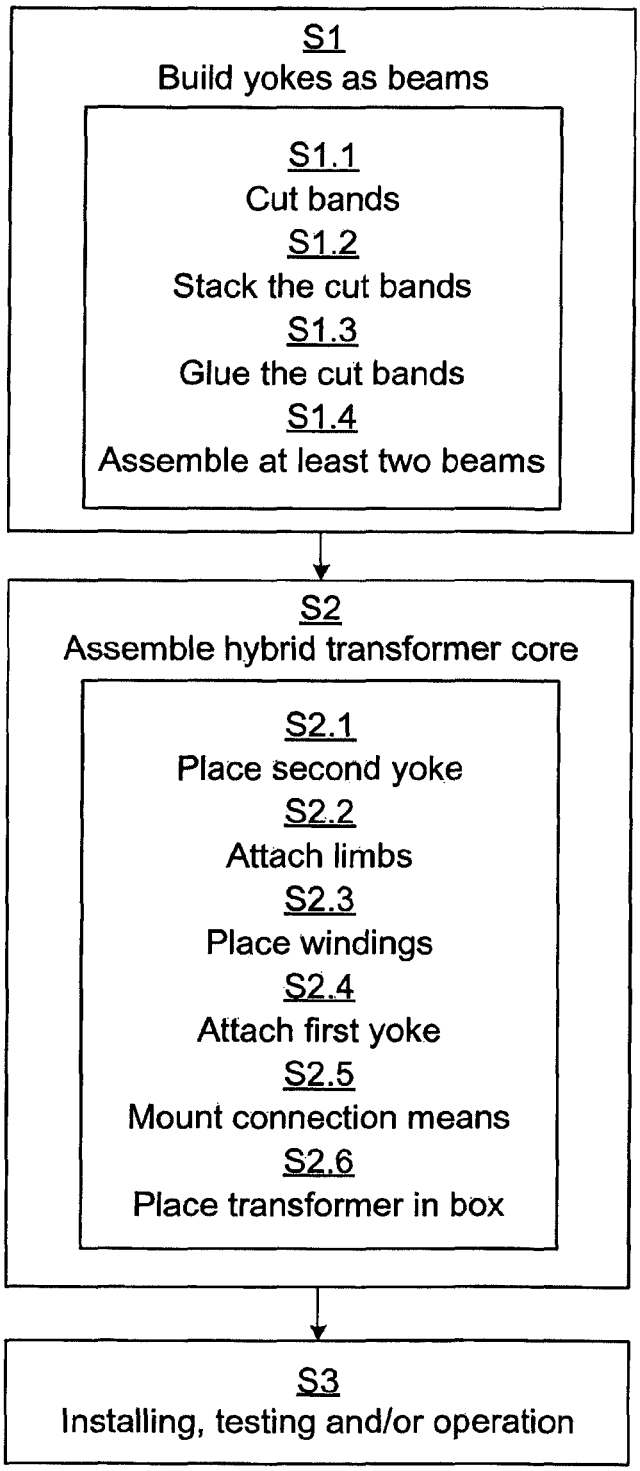
FIG. 11 is a flowchart for a method of manufacture of a transformer core as illustrated in any one of FIGS. 1-10.

A method of manufacturing a hybrid transformer core 1 will now be disclosed with references to the flowchart of FIG. 11. In brief the method comprises a step S1 of building yokes 2*a*, 2*b* (and limbs 3*a*, 3*b*) as beams (or rings) from bands, a step S2 of assembling a hybrid transformer core 1 by using the built beams, and a step S3 of installing, testing, and operating the assembled hybrid transformer core 1. Each of these steps will now be described in further detail.

Figure 9:
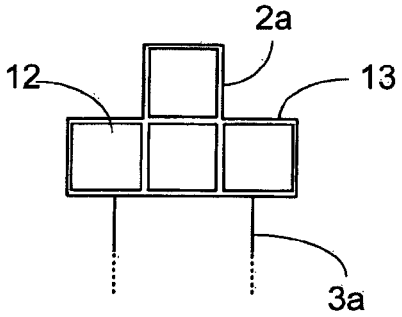
Figure 10:
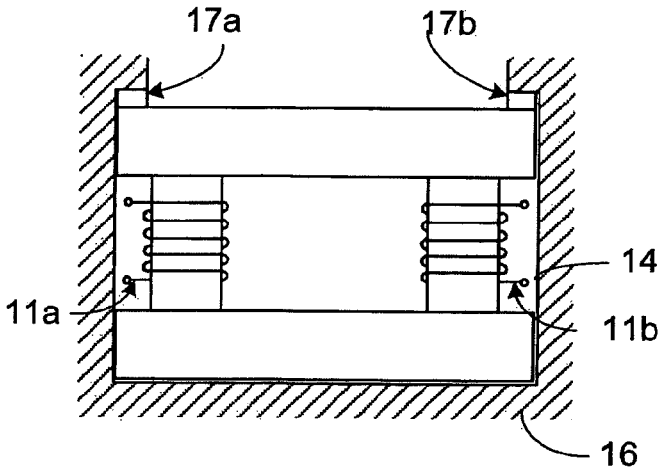

Building amorphous yokes 2*a*, 2*b* as beams 12 from bands, step S1, comprises a step S1.1 of cutting bands from plates of amorphous steel. The bands may be cut by a cutting machine. The cutting machine may use punching to cut the plates of amorphous steel. Alternatively the cutting machine may user laser beams to cut the steel. Laser is advantageously used in case the steel plates are thin or brittle. Since the plates are very thin only a low power laser cutter is needed. The height of the plates may be determined e.g.

from cost and manufacturing complexity. Some plates may be glued together before the plate is cut. In a step S1.2 the cut bands are stacked. During stacking the bands are may be placed in a fixture. Using a fixture also allows for vacuum molding, e.g., using epoxy. In order to reduce high magnetostriction a blade of oriented steel may be placed between the stacked blades at certain intervals (for example, in the order of one blade of oriented steel per 20 stacked blades). During stacking the blades are also glued, step S1.3, in order to form a beam 12. When yokes 2*a*, 2*b* are from amorphous bands the can easily be cut and stacked into beams and glued simultaneously. Amorphous beams can easily be locked to tank bottoms or tank walls to achieve the needed axial forces and tank support in all directions. The beam 12 may then be used as a yoke (such as there herein disclosed first 12*a* and second 12*b* yokes). Optionally, two or more individual beams 12 may be assembled, step S1.4, to form a composite beam 13. The composite beam 13 may then be used as a yoke (such as there herein disclosed first 2*a* and second 2*b* yokes). In FIG. 9 a composite beam 13 comprising four individual beams 12 is used as the first yoke 2*a*. In order to form a composite beam 13 the individual beams 12 are stacked, glued and molded together. The individual beams 12 may be bonded by Asecond. Asecond may be formed from non-cured epoxy materials, see WO2008020807 A1. Typically one yoke 2*a*, 2*b* is made from 1, 2, 4, 6, 8 or more individual beams 12. The yokes 2*a*, 2*b* may thus be stacked into an arbitrary width and height and hence the yokes 2*a*, 2*b* are no longer restricted to fixed sizes. Analogously with the above, the maximum height of the stacked beams (i.e., the center beams) may be about 1.3 times the diameter of the limbs 3*a*, 3*b*. The height of stacked beams is at the edges (i.e. the beams placed to the left and to the right of the center beams) then typically about 0.6 times the diameter of the limbs.

The same process as in step S1 (cutting, stacking, gluing, assembling) may be used to build grain-oriented limbs 3*a*, 3*b* as beams from bands.

In a step S2 a hybrid transformer core 1 is assembled by using the built beams 12. In a step S2.1 the bottom yoke (the second yoke 2*b*) is placed according to a preferred configuration. In this context the bottom yoke may be a composite beam 13 and hence be composed of one or more individual beams 12 as built during step S1. In a step S2.2 the limbs 3*a*, 3*b* are attached to the bottom yoke. The limbs 3*a*, 3*b* are thereby coupled to the bottom yoke. In a step S2.3 windings 11*a*, 11*b* may be placed over the limbs 3*a*, 3*b*. Alternatively the windings 11*a*, 11*b* may be wound around the limbs 3*a*, 3*b* at a later stage. In a step S2.4 the top yoke (the first yoke 2*a*) is attached to the limbs 3*a*, 3*b*. The top yoke is thereby coupled to the limbs 3*a*, 3*b*. In this context the top yoke may be a composite beam 13 and hence be composed of one or more individual beams 12 as built during step S1. In a step S2.5 connection means 14 are mounted to the windings 11*a*, 11*b*. In a step S2.6 the thus formed hybrid transformer core 1 is placed in a box (or tank) 16 and the yokes are fastened to the box (or tank) by fastening means 17*a*, 17*b*. Hence the hybrid transformer core 1 may be fastened to a box or tank 16 by means of fastening means 17*a*, 17*b* at least one of the yokes 2*a*, 2*b*. The fastening means may lock against vertical forces applied to the hybrid transformer core 1 during operation and also against the coercive force existing between the end surfaces of the limbs and the surfaces of the yokes. The fastening means may isolate the hybrid transformer core 1 from the box or tank 16. This may avoid the use of locking the hybrid transformer core 1 to the box or tank 16 by means of screws, nuts and/or bolts or the like.

In a step S3 the assembled hybrid transformer core 1 is installed, tested and operated.

The herein disclosed hybrid transformer cores may be provided in a reactor. There is thus disclosed a reactor comprising at least one hybrid transformer core as herein disclosed.

Hence the transformer cores according to embodiments as schematically illustrated in FIGS. 1-10 could equally well be a reactor core. In general terms, with regard to reactors (inductors), these comprise a core which mostly is provided with only one winding. In other respects, what has been stated above concerning transformers is substantially relevant also to reactors.

The reactor may be a shunt reactor or a series reactor. The herein disclosed transformer core may according to one embodiment be applied in reactors with air gaps without electrical core steel. Such reactors are preferably suitable for a reactive power in the region of kVAR (volt-ampere reactive) to a few MVAR. The herein disclosed transformer core may according to another embodiment be applied in reactors with air gaps with (electrical) core steel. Such reactors are preferably suitable for a reactive power in the region of several MVAR.

The invention has mainly been described above with reference to a few embodiments. However, as is readily appreciated by a person skilled in the art, other embodiments than the ones disclosed above are equally possible within the scope of the invention, as defined by the appended patent claims. For example, generally, since the amorphous yokes can be built up of parallel widths of existing amorphous bands the disclosed transformer is not limited to any maximum size.

The invention claimed is:

1. A hybrid transformer core, comprising:

a first yoke composed of at least one yoke beam, each yoke beam of the first yoke comprising a first plurality of stacked yoke plates of amorphous steel, and a second yoke composed of at least one yoke beam, each yoke beam of the second yoke comprising a second plurality of stacked yoke plates of amorphous steel; and at least two limbs of grain-oriented steel extending between the first yoke and the second yoke, wherein a first end of each one of the at least two limbs is coupled directly to a first surface of the first yoke in a first connection plane defined by the first surface and wherein a second end of each one of the at least two limbs is coupled directly to a second surface of the second yoke in a second connection plane defined by the second surface, wherein the first yoke along the first connection plane extends in all directions beyond a contour of the first end of each one of the at least two limbs, and wherein the second yoke along the second connection plane extends in all directions beyond a contour of the second end of each one of the at least two limbs.

2. The hybrid transformer core according to claim 1, wherein each one of the at least two limbs has a diameter, wherein the first yoke extends perpendicularly from the first connection plane 1.1-1.5 times the diameters of the limbs, and wherein the second yoke extends perpendicularly from the second connection plane 1.1-1.5 times the diameters of the limbs.

3. The hybrid transformer core according to claim 1, wherein for each one of the first and second yokes, the at least one yoke beam comprises two yoke beams bonded together.

4. The hybrid transformer core according to claim 1, wherein the first plurality of stacked yoke plates and second plurality of stacked yoke plates are oriented parallel to a first plate plane perpendicular to the first and second connection planes, the first plate plane extending between the at least two limbs.

5. The hybrid transformer core according to claim 1, wherein at least one of the first yoke and second yoke comprises at least two yoke beams of different lengths, wherein the yoke beam to which the each one of the at least two limbs is coupled is the longest of the at least two yoke beams.

6. The hybrid transformer core according to claim 1, wherein each one of the at least two limbs are composed of a plurality of stacked limb plates of grain-oriented steel.

7. The hybrid transformer core according to claim 4, wherein each one of the at least two limbs are composed of a plurality of stacked limb plates of grain-oriented steel, and wherein the limbs are oriented such that the plurality of stacked limb plates are parallel to the first plate plane.

8. The hybrid transformer core according to claim 1, wherein the first yoke and the second yoke and/or the at least two limbs have circular, ellipsoidal, squared or rectangular shaped cross-sections.

9. The hybrid transformer core according to claim 1, wherein the first end of each one of the at least two limbs is glued to the first surface of the first yoke, and wherein the second end of each one of the at least two limbs is glued to the second surface of the second yoke.

10. The hybrid transformer core according to claim 1, wherein the amorphous steel of the first and second yokes has same isotropy in all directions.

11. The hybrid transformer core according to claim 1, wherein each one of the at least two limbs has a diameter, wherein the first yoke and the second yoke extend in length from the hybrid transformer core a total distance of at least the diameter of one limb.

12. The hybrid transformer core according to claim 1, wherein each one of the at least two limbs has a diameter, wherein the first yoke and the second yoke extend in width from the hybrid transformer core a total distance of at least the diameter of one limb.

13. The hybrid transformer core according to claim 1, further comprising at least one winding, each one of the at least one winding being wound around one of the at least two limbs, thereby forming at least one wound limb, the at least one wound limb having a diameter, wherein the first yoke and the second yoke have a width of at least the diameter of the at least one wound limb.

14. The hybrid transformer core according to claim 1, wherein at least one of the first yoke and second yoke comprises fastening means for fastening the hybrid transformer core to at least one wall of a tank or a box.

15. A reactor comprising:

at least one hybrid transformer core, wherein said at least one hybrid transformer core includes a first yoke composed of at least one yoke beam, each yoke beam of the first yoke comprising a first plurality of stacked yoke plates of amorphous steel, and a second yoke composed of at least one yoke beam, each yoke beam of the second yoke comprising a second plurality of stacked yoke plates of amorphous steel; and at least two limbs of grain-oriented steel extending between the first yoke and the second yoke, wherein a first end of each one of the at least two limbs is coupled directly to a first surface of the first yoke in a first connection plane defined by the first surface and wherein a second end of each one of the at least two limbs is coupled directly to a second surface of the second yoke in a second connection plane defined by the second surface, wherein the first yoke along the first connection plane extends in all directions beyond a contour of the first end of each one of the at least two limbs, and wherein the second yoke along the second connection plane extends in all directions beyond a contour of the second end of each one of the at least two limbs.

16. The reactor according to claim 15, wherein the reactor is either a shunt reactor or a series reactor.

17. A hybrid transformer core, comprising:

a first yoke composed of at least one yoke beam, each yoke beam of the first yoke comprising a first plurality of stacked yoke plates of amorphous steel, and a second yoke composed of at least one yoke beam, each yoke beam of the second yoke comprising a second plurality of stacked yoke plates of amorphous steel; and at least two limbs of grain-oriented steel extending between the first yoke and the second yoke, wherein a first end of each one of the at least two limbs is glued directly to a first surface of the first yoke in a first connection plane defined by the first surface and wherein a second end of each one of the at least two limbs is glued directly to a second surface of the second yoke in a second connection plane defined by the second surface, wherein the first yoke along the first connection plane extends in all directions beyond a contour of the first end of each one of the at least two limbs, wherein the second yoke along the second connection plane extends in all directions beyond a contour of the second end of each one of the at least two limbs, and wherein each one of the at least two limbs has a diameter, the first yoke extends perpendicularly from the first connection plane 1.1-1.5 times the diameters of the limbs, and wherein the second yoke extends perpendicularly from the second connection plane 1.1-1.5 times the diameters of the limbs.

18. The hybrid transformer core according to claim 17, wherein at locations where the first and second yokes and the at least two limbs are connected, each of the first yoke and the second yoke is wider than the diameters of the limbs and longer than the diameters of the limbs.

19. The hybrid transformer core according to claim 18, wherein the first yoke has a length such that the first yoke extends beyond the contour of the first end of each one of the at least two limbs by at least half the diameter of one of the limbs, and wherein the second yoke has a length such that the second yoke extends beyond the contour of the second end of each one of the at least two limbs by at least half the diameter of one of the limbs.

20. The hybrid transformer core according to claim 18, wherein the first yoke has a width such that the first yoke extends beyond the contour of the first end of each one of the at least two limbs by at least half the diameter of one of the limbs, and wherein the second yoke has a width such that the second yoke extends beyond the contour of the second end of each one of the at least two limbs by at least half the diameter of one of the limbs.

* * * * *